US005924361A

United States Patent [19]

Watanabe

[11] Patent Number: 5,924,361

[45] Date of Patent: Jul. 20, 1999

[54] METHOD FOR PERFORATING HEAT SENSITIVE STENCIL SHEET

[75] Inventor: Hideo Watanabe, Inashiki-gun, Japan

[73] Assignee: Riso Kagaku Corporation, Tokyo, Japan

[21] Appl. No.: 08/872,175

[22] Filed: Jun. 10, 1997

[30] Foreign Application Priority Data

Jun. 10, 1996 [JP] Japan ..... 8-170527

[51] Int. Cl.[6] ..... B41C 1/14

[52] U.S. Cl. ..... 101/128.4; 101/128.21

[58] Field of Search ..... 101/128.4, 128.21

[56] References Cited

U.S. PATENT DOCUMENTS

| | | | |
|---|---|---|---|
| 2,760,863 | 12/1956 | Plambeck, Jr. | 430/306 |
| 3,467,518 | 9/1969 | Laridon et al. | 430/306 |
| 4,139,759 | 2/1979 | Hayama et al. | 219/216 |
| 4,996,137 | 2/1991 | Inoue et al. | 430/378 |
| 5,146,236 | 9/1992 | Hirata et al. | 346/1.1 |
| 5,415,090 | 5/1995 | Natori et al. | 400/120.01 |
| 5,662,039 | 9/1997 | Watanabe | 101/128.4 |

FOREIGN PATENT DOCUMENTS

| | | |
|---|---|---|
| 0 635 362 | 1/1995 | European Pat. Off. . |
| 0 767 053 | 4/1997 | European Pat. Off. . |
| 51-7588 | 3/1976 | Japan . |
| 51-7589 | 3/1976 | Japan . |
| 1 431 462 | 4/1976 | United Kingdom . |

*Primary Examiner*—Edgar Burr
*Assistant Examiner*—Daniel J. Colilla
*Attorney, Agent, or Firm*—Pillsbury Madison & Sutro LLP

[57] ABSTRACT

A method of perforating a heat-sensitive stencil sheet is provided which can give prints of high quality having sharp images high in density and free from seep through. This method comprises ejecting a photothermal conversion material contained in a liquid together with the liquid from a liquid ejector to transfer it in the form of dots onto a heat-sensitive stencil sheet, and then exposing the heat-sensitive stencil sheet to a visible or infrared ray to perforate the heat-sensitive stencil sheet specifically at portions to which the photothermal conversion material has been transferred, the dots satisfying the relation $3R \geqq D > R$ in which R is diameter of the dot of the photothermal conversion material transferred and recorded onto the heat-sensitive stencil sheet and D is a pitch between adjacent dots. It is preferred that the heat-sensitive stencil sheet has a liquid absorbing layer on at least one side, and the liquid containing the photothermal conversion material is ejected onto the liquid absorbing layer. The liquid absorbing layer preferably has a contact angle with the liquid of 20–150 degrees. The liquid absorbing layer can be formed by appropriately mixing a hydrophilic resin and a water-repellent compound.

10 Claims, 2 Drawing Sheets

METHOD FOR PERFORATING HEAT SENSITIVE STENCIL SHEET

BACKGROUND OF THE INVENTION

1. Field of the Invention

The present invention relates to a method for perforating a heat-sensitive stencil sheet, and more specifically relates to a method of perforating a heat-sensitive stencil sheet by exposing it to a visible or infrared ray to make a master for stencil or screen printing.

2. Description of Related Art

As a structure of conventional heat-sensitive stencil sheets, is known a multilayer which is composed of a thermoplastic film laminated to an ink-permeable porous substrate made of Japanese paper or the like, or one layer which is composed simply of a thermoplastic film.

Methods for perforating such heat-sensitive stencil sheets to obtain masters for stencil or screen printing, include (1) a process of overlaying a heat-sensitive stencil sheet on images or letters that have been formed with carbon-containing materials such as pencils and toner by hand-writing or photocopying, and then exposing it to light from flash lamps, infrared lamps or the like to cause the portions of letters or images to emit heat so that the thermoplastic film of the stencil sheet is molten and perforated at portions that contact the images or letters, and (2) a process of melting and perforating the thermoplastic film of the stencil sheet by bringing the stencil sheet into contact with a thermal printing head which emits heat in dot-matrix forms so as to reproduce images in accordance with image data of electric signals that original images or letters have been transformed into.

In the above process (1), however, failure in perforation often occurs due to insufficient contact of the thermoplastic film of the stencil sheet with the original or the photocopied image portions of toner from which heat is emitted, or problems on so-called "pin holes" also occur which are phenomena of perforations caused in the stencil sheet at undesired portions by heat emitted from dust on the surface of the original or toner scattered out of the image portions. In the above process (2), there often occur perforation failure, conveying failure and wrinkling of the stencil sheet due to unevenness of pressure exerted to press the stencil sheet to the thermal printing head.

In order to solve such problems, the present inventor suggested, in Japanese Patent Application No. 284610/95, a method for perforating a heat-sensitive stencil sheet, which comprises ejecting a photothermal conversion material contained in a liquid from a liquid-ejecting means to transfer it together with the liquid to a heat-sensitive stencil sheet, and then exposing the heat-sensitive stencil sheet to a visible or infrared ray to perforate the heat-sensitive stencil sheet specifically at portions to which the photothermal conversion material has been transferred.

This perforating method comprises a first step of controlling a liquid-ejecting means to eject the liquid containing the photothermal conversion material as droplets onto a heat-sensitive stencil sheet in accordance with image data that have previously been transformed into electric signals while the liquid-ejecting means, which is maintained out of contact with the stencil sheet, is moved relative to the heat-sensitive stencil sheet, whereby the image is reproduced on the heat-sensitive stencil sheet as adherends in the form of dots composed of the photothermal conversion material and a second step of perforating the heat-sensitive stencil sheet specifically at sites to which the photothermal conversion material has been transferred, by subjecting the stencil sheet to a visible or infrared ray.

The perforation method is advantageous in that little pin hole is formed in the stencil sheet since the stencil sheet does not have to be brought into contact with the original or the liquid ejecting means upon perforation. Similarly, since the stencil sheet is liberated from contact with the original or a thermal printing head that has been required in conventional perforating methods, any problem of perforation failure due to contact failure does not occur, and the stencil sheet is perforated faithfully to image information.

However, according to the investigation conducted by the present inventor, it has been found that the perforantions in the stencil sheet made by the above methods include those which are continuous and those which are independent from each other. In the case of perforantions being in continuous state, ink passes through the stencil sheet in an amount more than needed to cause blur of printed images or letters, resulting in deterioration of print quality, and, furthermore, setting off or seeping through of the ink is apt to occur.

On the other hand, it has been found that in the case of perforations being independent from each other, a proper amount of ink passes through the perforated portion of the stencil sheet and, as a result, clear images and letters can be obtained upon printing and setting off hardly occurs, resulting in prints of high quality. However, it has been found that when the pitch between adjacent dots is too great as compared with the diameter of dots, then density of prints decreases or resolution deteriorates.

The object of the present invention is to provide a method of perforating a heat-sensitive stencil sheet, which is capable of providing a print of high quality that is sharp and high in density and free from setting off of ink, by forming perforations in the form of dots that are substantially independent from each other.

SUMMARY OF THE INVENTION

According to the present invention, the above object has been attained by a method of perforating a heat-sensitive stencil sheet, which comprises ejecting a photothermal conversion material contained in a liquid from a liquid-ejecting means to transfer it together with the liquid to a heat-sensitive stencil sheet in the form of dots, and then exposing the heat-sensitive stencil sheet to a visible or infrared ray to perforate the heat-sensitive stencil sheet specifically at portions to which the photothermal conversion material has been transferred, characterized in that said dots satisfy the relationship $3R \geqq D > R$ where R is the diameter of the dots of the photothermal conversion material transferred and recorded on the heat-sensitive stencil sheet and D is the pitch between adjacent dots.

DETAILED DESCRIPTION

That is, according to the present perforation method, while a liquid-ejecting means is moved relative to the heat-sensitive stencil sheet in such a manner that the liquid-ejecting means is maintained out of contact with the stencil sheet, a liquid which contains a photothermal conversion material is ejected as droplets onto the heat-sensitive stencil sheet from the liquid-ejecting means in accordance with image information previously converted to electric signals, thereby to record the image on the stencil sheet as a mass of dots of the photothermal conversion material, wherein the liquid containing thermal conversion material is transferred so that the dots recorded satisfy $3R \geqq D > R$. As a result, the perforations obtained by exposing the heat-sensitive stencil sheet to a visible or infrared ray are substantially discrete and independent, and there is provided a print which is sharp and free from setting off.

Hereupon, the term "recorded" means that the liquid containing photothermal conversion material is transferred onto the stencil sheet and the liquid is evaporated or absorbed to fix the photothermal conversion material on the stencil sheet. If the dot is not a regular circle, R can be an average value of the longer diameter and the shorter diameter. The range of R varies depending on nozzle diameter of the liquid-ejecting means used, but is generally 2000-10 $\mu$m. The term "adjacent dots" means a pair of adjacent dots in the area where dots are most densely distributed within an image. The term "image" includes letters.

If R which is a diameter of dot of the recorded photothermal conversion material and D which is a pitch between the dots have a relation shown by $D \leqq R$, perforations of the heat-sensitive stencil sheet formed by exposing the sheet to a visible or infrared ray are continued, and, as a result, resolution lowers and a large amount of ink passes through the perforated part at the time of stencil printing to give blurred and indefinite images. On the other hand, when R and D have a relation $3R<D$, distribution of the perforations in the image is sparse, and the images of prints are indefinite and low in density even if a soft ink is used.

In the perforation method of the present invention, if droplets of the liquid ejected from the liquid-ejecting means blot or are repelled on the stencil sheet after they are trasferred thereto, it sometimes becomes difficult to satisfy the relation $3R \geqq D>R$. Therefore, it is preferred to use a heat-sensitive stencil sheet having a liquid absorbing layer on at least one side and eject the liquid onto the liquid absorbing layer. In this case, it also becomes possible to promote fixation or drying of the liquid.

The liquid absorbing layer is preferably such that a contact angle of 20–150 degrees, preferably 30–130 degrees is provided between the liquid and the liquid absorbing layer when the liquid containing photothermal conversion material is transferred onto the liquid absorbing layer. If the contact angle is smaller than 20 degrees, the transferred liquid blots or spreads on the liquid absorbing layer and the relation $D>R$ cannot be readily satisfied, and if the contact angle is greater than 150 degrees, the liquid is repelled on the liquid absorbing layer to cause so-called beading phenomenon, and the relation $3R \geqq D$ cannot be readily satisfied and the liquid cannot be fixed on the liquid absorbing layer without difficulty and takes much time to dry.

The liquid absorbing layer having the above contact angle can be obtained by suitably mixing a hydrophilic resin and a water-repellent compound. Thus, when the liquid containing the photothermal conversion material is transferred onto the liquid absorbing layer, first due to the effect of the water-repellent compound, the liquid is transferred at an angle of 20–150 degrees with the absorbing layer and next due to the effect of the hydrophilic resin, the liquid dissolves or swells the liquid absorbing layer. Therefore, the photothermal conversion material fixed on the liquid absorbing layer does not blot or spread, and, furthermore, the liquid is not repelled. As a result, a letter or image can easily be recorded on the heat-sensitive stencil sheet as a mass of dots of the photothermal conversion material, satisfying the relation $3R \geqq D>R$. Thus, perforations in a desired form of letters or images can be made in the heat-sensitive stencil sheet upon exposure to a visible or infrared ray.

Concrete blending proportion of the hydrophilic resin to the water-repellent compound (i.e., the hydrophilic resin/the water-repellent compound) varies depending upon kinds of the liquid containing photothermal conversion materials, and would be appropriately selected by the skilled in the art, usually within a range of 99/1 to 1/99, preferably 90/10 to 10/90.

The hydrophilic resin used for the liquid absorbing layer of the present invention includes, for example, polyvinyl alcohol, methyl cellulose, carboxymethyl cellulose, hydroxyethyl cellulose, polyvinyl pyrrolidone, ethylene-vinyl alcohol copolymers, polyethylene oxide, polyvinyl ether, polyvinyl acetal, polyvinyl butyral, polyacrylamide, and the like. These resins can be used alone, in combination or as a copolymer.

The water-repellent compound used for the liquid absorbing layer of the present invention includes fluorinated compounds, silane compounds, waxes, higher fatty acids, higher fatty acid amides and polyolefins, for example, tetrafluoroethylene resin, tetrafluoroethylenehexafluoropropylene copolymer, tetrafluoroethyleneperfluoroalkyl vinyl ether copolymer, silicone resin, dimethylsilicone oil, methylphenylsilicone oil, cyclic dimethylsiloxane, modified silicone oil, carnauba wax, microcrystalline wax, polyethylene wax, montan wax, paraffin wax, candelilla wax, shellac wax, oxide wax, ester wax, bees wax, haze wax, spermaceti, stearic acid, lauric acid, behenic acid, caproic acid, palmitic acid, stearic acid amide, lauric acid amide, behenic acid amide, caproic acid amide, palmitic acid amide, polyethylene, polypropylene, and the like. These water-repellent compounds can be used as solid powders or liquid, and can be contained in the liquid absorbing layer in dissolved or dispersed state.

In order to promote absorption and fixation of the liquid containing photothermal conversion materials in the liquid absorbing layer, organic or inorganic particulates may be added to the liquid absorbing layer. Such particulates include organic particulates such as of polyurethane, polyethylene terephthalate, polybutylene terephthalate, polyethylene, polystyrene, silicone resin such as polysiloxane, phenol resin, acrylic resin, and benzoguanamine resin, and inorganic particulates such as of talc, clay, calcium carbonate, titanium oxide, aluminum oxide, silicon oxide and kaolin.

The liquid absorbing layer of the present invention preferably has a softening or melting point of 40 to 120° C., more preferably 50 to 100° C. When it is less than 40° C., the liquid absorbing layer is influenced by the environmental temperature at which heat-sensitive stencil sheets are stored, and stencil sheets are often changed in mechanical or thermal properties, causing troubles upon perforation or printing. When it is more than 120° C., perforation of a stencil sheet requires a large amount of heat energy, takes much time, and requires a high-powered perforating apparatus.

The liquid absorbing layer of the present invention preferably has a thickness of 0.01 to 20 $\mu$m, more preferably 0.05 to 10 $\mu$m. When it is less than 0.01 $\mu$m, the liquid ejected with photothermal conversion materials is not sufficiently fixed. When it is more than 20 $\mu$m, perforation of the stencil sheet requires a large amount of heat energy, takes much time, and requires a high-powered perforating apparatus.

The liquid absorbing layer can be formed on a heat-sensitive stencil sheet, for example, by applying a mixed solution containing the above hydrophilic resin and the above water-repellent compound and if necessary the above organic or inorganic particulate, to a stencil sheet by use of a coating means such as a gravure coater and a wire bar coater, and then drying it.

The heat-sensitive stencil sheet may be a stencil sheet which can be molten and perforated by heat emitted by photothermal conversion materials. The stencil sheet may be made of a thermoplastic film only, or may be a thermoplastic film laminated to a porous substrate.

The thermoplastic film includes a film made from polyethylene, polypropylene, polyvinyl chloride, polyvinylidene chloride, polyethylene terephthalate, polybutylene terephthalate, polystyrene, polyurethane, polycarbonate, polyvinyl acetate, acrylic resin, silicone resin, or other resinous compounds. These resinous compounds may be used alone, in combination, or as a copolymer. Suitable thickness of the thermoplastic film is 0.5–50 $\mu$m, preferably 1–20 $\mu$m. If the film is less than 0.5 $\mu$m in thickness, it is inferior in workability and strength. If the film is greater in thickness than 50 $\mu$m, it is not economical because a great amount of heat energy is required upon perforation.

The above porous substrate may be a thin paper, a nonwoven fabric, a gauze or the like, which is made from natural fibers such as Manila hemp, pulp, Edgeworthia, paper mulberry and Japanese paper, synthetic fibers such as of polyester such as polyethylene terephthalate, nylon, vinylon and acetate, metallic fibers, or glass fibers, alone or in combination. Basis weight of these porous substrates is preferably 1–20 g/m$^2$, more preferably 5–15 g/m$^2$. If it is less than 1 g/m$^2$, stencil sheets are weak in strength. If it is more than 20 g/m$^2$, stencil sheets are often inferior in ink permeability upon printing. Thickness of the porous substrate is preferably 5–100 $\mu$m, more preferably 10–50 $\mu$m. If the thickness is lower than 5 $\mu$m, stencil sheets are weak in strength. If it is greater than 100 $\mu$m, stencil sheets are often inferior in ink permeability upon printing.

The photothermal conversion material used in the present invention is a material which can transform light energy into heat energy, and is preferably a material efficient in photothermal conversion, such as carbon black, lampblack, silicon carbide, silicon nitride, metal powders, metal oxides, inorganic pigments, organic pigments, and organic dyes. Among organic dyes, preferred are those having a high light-absorbency within a specific range of wavelength, such as anthraquinone colorings, phthalocyanine colorings, cyanine colorings, squalirium colorings, and polymethine colorings.

The liquid in which the photothermal conversion material is contained according to the present invention may be water and/or hydrophilic solvents. The hydrophilic solvents include alcoholic solvents such as methyl alcohol, ethyl alcohol, isopropyl alcohol and butyl alcohol, glycol solvents such as ethylene glycol, diethylene glycol, triethylene glycol, propylene glycol, ethylene glycol dibutyl ether, diethylene glycol dibutyl ether, thioglycol, thiodiglycol and glycerin as well as ketone, amine and ether solvents. Such ketone, amine and ether hydrophilic solvents include acetone, methyl ethyl ketone, tetrahydrofuran, 1,4-dioxane, 2-pyrrolidone, N-methyl-2-pyrrolidone, formaldehyde, acetaldehyde, methylamine, ethylenediamine, dimethylformamide, dimethyl sulfoxide, pyridine, ethylene oxide and the like.

To the liquid, may be added pigments, fillers, binders, hardening agents, preservatives, wetting agents, surfactants, pH-adjusting agents or the like, as required.

Thus, a composition for perforating a heat-sensitive stencil sheet can be prepared by appropriately dispersing or mixing the above photothermal conversion material in or with the above liquid, in a form readily ejectable from the liquid-ejecting means.

The present method for perforating a stencil sheet to make a master for screen or stencil printing can be practiced by effecting a first step in which the above liquid containing the photothermal conversion material is ejected from the liquid-ejecting means onto the heat-sensitive stencil sheet to transfer the photothermal conversion material to the stencil sheet, and a second step in which the heat-sensitive stencil sheet is perforated specifically at sites to which the photothermal conversion material has been transferred, by subjecting the stencil sheet to a visible or infrared ray.

The first step of the present method can be practiced, for example, by controlling the liquid-ejecting means to eject the liquid onto a heat-sensitive stencil sheet while the liquid-ejecting means, which is maintained out of contact with the stencil sheet, is moved relative to the heat-sensitive stencil sheet in accordance with image data that have previously been transformed into electric signals, so that the image is reproduced on the heat-sensitive stencil sheet as adherends mainly composed of the photothermal conversion material.

The liquid-ejecting means may be a device which comprises nozzles, slits, a porous material, or a porous film having 10–2000 openings per inch (i.e., 10 to 2000 dpi) and connected to piezoelectric elements, heating elements, liquid-conveying pumps or the like so as to eject the liquid containing the photothermal conversion material, intermittently, that is, in a form of dots, in accordance with the electric signals for letters or images.

In the second step of the present method, when a visible or infrared ray is applied to the heat-sensitive stencil sheet to which the photothermal conversion material has been transferred, the photothermal conversion material absorbs light to emit heat. As a result, the thermoplastic film and the liquid absorbing layer of the heat-sensitive stencil sheet are molten and perforated to give a master for screen or stencil printing. In this way, the present perforating method does not require the stencil sheet to contact any substance such as an original or thermal printing head to make a master, but only requires the stencil sheet itself to be exposed to a visible or infrared ray. Thus, no wrinkling occurs on stencil sheets upon making masters. The visible or infrared ray can readily be radiated using xenon lamps, flash lamps, halogen lamps, infrared heaters or the like.

The stencil sheet which has been perforated in accordance with the present invention can serve for printing with ordinary stencil printing apparatuses. For example, printed matter is obtained by placing printing ink on one side of the perforated stencil sheet, putting printing paper on the other side of the stencil sheet, and then passing the ink through the perforated portions of the stencil sheet by means of pressing, pressure-reducing or squeezing so as to transfer the ink onto the printing paper. Printing ink may be those conventionally used in stencil printing, such as oil ink, aqueous ink, water-in-oil (W/O) emulsion ink, oil-in-water (O/W) emulsion ink, and hot melt ink.

Hereinafter, the present invention will be explained in more detail by way of the following examples with reference to the accompanying drawings in which:

It should be construed that the following examples are presented for only illustrative purpose, and the present invention is not limited to the examples.

EXAMPLE 1

A mixed liquid of 1 part by weight of polyvinyl butyral, 2 parts by weight of fluororesin powder, 30 parts by weight of water and 67 parts by weight of isopropyl alcohol was applied to a polyethylene terephthalate film of 2 $\mu$m in thickness with a wire bar coater, and dried to form a liquid absorbing layer of 0.5 $\mu$m in thickness. Then, a Japanese paper of 10 g/m$^2$ in basis weight was laminated to the film on the side opposite to the liquid absorbing layer to obtain a heat-sensitive stencil sheet having a three layer structure of a liquid absorbing layer 1, a thermoplastic film 2 and a porous substrate 3, as shown in FIG. 1.

On the other hand, a liquid containing a photothermal conversion material was prepared by mixing 3 parts by weight of carbon black, 50 parts by weight of water, 30 parts by weight of diethylene glycol and 17 parts by weight of 2-pyrrolidone.

Figure 1:
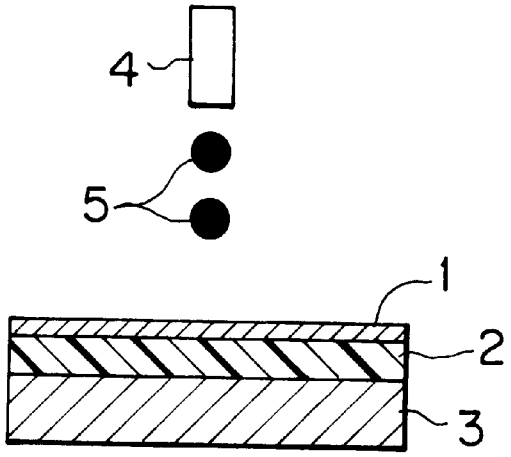
FIG. 1 is a sectional side view which diagrammatically shows a state in which a liquid containing a photothermal conversion material is ejected from a liquid ejecting means to a liquid absorbing layer of a heat-sensitive stencil sheet.
Figure 2:
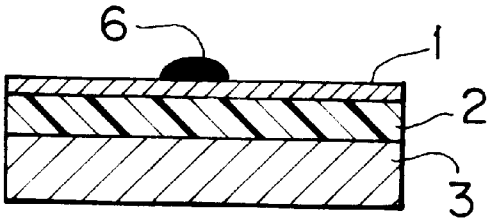
FIG. 2 is a sectional side view which diagrammatically shows a state in which a liquid containing a photothermal conversion material is transferred onto a heat-sensitive stencil sheet.
Figure 5:
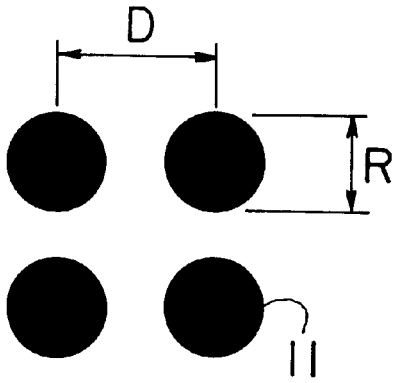
FIG. 5 is an enlarged diagrammatical plan view which shows one example of arrangement of dots of a photothermal conversion material recorded on a stencil sheet according to the present invention.

Then, as shown in FIG. 1, droplets 5 of the liquid containing the photothermal conversion material were ejected as a letter image from nozzles 4 of a liquid ejecting means connected to a piezoelectric element onto the liquid absorbing layer 1 of the heat-sensitive stencil sheet so that the recorded dots had a diameter of 60 $\mu$m and the pitch between the dots was 100 $\mu$m, thereby to transfer the liquid onto the heat-sensitive stencil sheet as liquid 6 and fix it to form letter images as shown in FIGS. 2 and 5. In this moment, the contact angle of the liquid 6 with the liquid absorbing layer 1 to which the liquid 6 has been transferred was 60 degrees.

Figure 3:
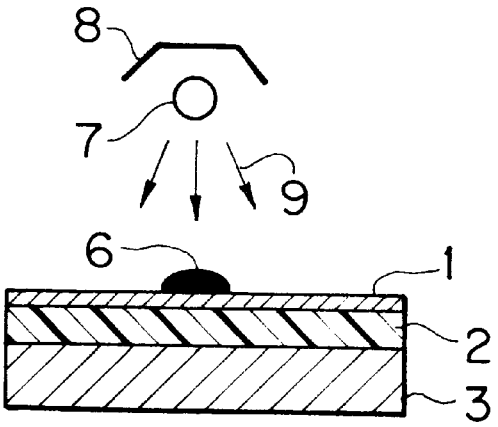
FIG. 3 is a sectional side view which diagrammatically shows a state in which light is radiated to a heat-sensitive stencil sheet onto which a liquid containing a photothermal conversion material has been transferred.
Figure 4:
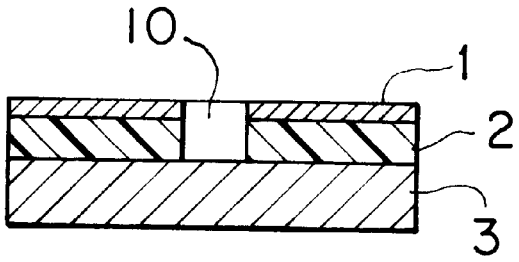
FIG. 4 is a sectional side view which diagrammatically shows a state in which a heat-sensitive stencil sheet is perforated after exposed to light.
Figure 6:
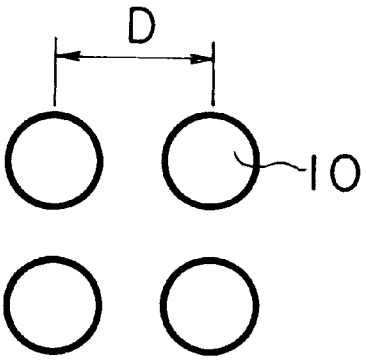
FIG. 6 is an enlarged diagrammatical plan view which shows one example of arrangement of perforations obtained by perforating a stencil sheet according to the present invention.

Then, light 9 was radiated to letter image portions at which the liquid 6 containing the photothermal conversion material had been transferred and fixed, by use of a xenon flash 7 (SP275 manufactured by RISO KAGAKU CORPORATION) accompanied with a light reflector 8, as shown in FIG. 3. As a result, thanks to heat emitted by the photothermal conversion material at the letter image portions, the liquid absorbing layer 1 and the thermoplastic film 2 were molten to form perforations 10 as shown in FIG. 4. Thus, the stencil sheet was perforated. It was confirmed that the perforation state of the stencil sheet was such that diameter of the perforations was 80 $\mu$m and the dots were independent from each other as shown in FIG. 6.

Then, stencil printing was effected using a digital stencil printing apparatus "RISOGRAPH GR275" (trade name) manufacture by RISO KAGAKU CORPORATION with the perforated stencil sheet being wound around the printing drum of the printing apparatus. As a result, sharp images were obtained.

EXAMPLE 2

A mixed liquid of 1 part by weight of polyvinyl alcohol, 2 parts by weight of alcohol-modified silicone oil, 70 parts by weight of water and 27 parts by weight of isopropyl alcohol was applied to a polyethylene terephthalate film of 2 $\mu$m in thickness with a wire bar coater, and dried to form a liquid absorbing layer of 0.5 $\mu$m in thickness. Then, a sheet of a polyester cloth leaf of 200 mesh was laminated to the film on the side opposite to the liquid absorbing layer to obtain a heat-sensitive stencil sheet.

Then, the same photothermal conversion material containing liquid as used in Example 1 was ejected from the same liquid-ejecting means as used in Example 1 to transfer and fix the liquid on the stencil sheet in the form of letter image so that the recorded dots had a diameter of 80 $\mu$m and the pitch between the dots was 110 $\mu$m. In this moment, the contact angle of the liquid with the liquid absorbing layer to which the liquid was transferred was 80 degrees.

Then, light was radiated to letter image portions to which the photothermal conversion material was fixed, by use of a xenon flash (SP275 manufactured by RISO KAGAKU CORPORATION) in the same manner as in Example 1. As a result, thanks to heat emitted by the letter image portions, the stencil sheet was molten and perforated. It was confirmed that the perforation state of the stencil sheet was such that diameter of the perforations was 90 $\mu$m and the dots were independent from each other.

Then, stencil printing ink "HIMESHINK" (trade name) manufactured by RISO KAGAKU CORPORATION was placed on the polyester cloth leaf of the above perforated stencil sheet, and printing was effected with a portable stencil printing machine "PRINT GOCCO" (trade name) manufacture by RISO KAGAKU CORPORATION using the above stencil sheet. As a result, sharp images were obtained.

EXAMPLE 3

A mixed liquid of 2 parts by weight of carboxymethyl cellulose, 1 part by weight of alcohol-modified silicone oil, 1 part by weight of silicon oxide particulates, 70 parts by weight of water and 26 parts by weight of isopropyl alcohol was applied to a polyvinylidene chloride film of 7 $\mu$m in thickness with a wire bar coater, and dried to form a liquid absorbing layer of 0.4 $\mu$m in thickness. Then, a polyester cloth leaf of 200 mesh was laminated to the film on the side opposite to the liquid absorbing layer to obtain a heat-sensitive stencil sheet.

Then, the same photothermal conversion material containing liquid as used in Example 1 was ejected from the same liquid-ejecting means as used in Example 1 to transfer and fix the liquid onto the stencil sheet in the form of letter image so that the recorded dots had a diameter of 80 $\mu$m and the pitch between the dots was 120 $\mu$m. In this moment, the contact angle of the liquid with the liquid absorbing layer to which the liquid was transferred was 50 degrees.

Then, light was radiated to letter image portions to which the photothermal conversion material was fixed, by use of a xenon flash (SP275 manufactured by RISO KAGAKU CORPORATION) in the same manner as in Example 1. As a result, thanks to heat emitted by the letter image portions, the stencil sheet was molten and perforated. It was confirmed that the perforation state of the stencil sheet was such that diameter of the perforations was 100 $\mu$m and the dots were independent from each other.

Then, stencil printing ink "HIMESH INK" (trade name) manufactured by RISO KAGAKU CORPORATION was placed on the polyester cloth leaf of the above perforated stencil sheet, and printing was effected with a portable stencil printing machine "PRINT GOCCO" (trade name) manufacture by RISO KAGAKU CORPORATION using the above stencil sheet. As a result, sharp images were obtained.

EXAMPLE 4

A mixed liquid of 1 part by weight of polyvinyl acetal, 3 parts by weight of polyether-modified silicone oil, 50 parts by weight of water and 46 parts by weight of isopropyl alcohol was applied to a polyethylene terephthalate film of 2 $\mu$m in thickness with a wire bar coater, and dried to form a liquid absorbing layer of 0.3 $\mu$m in thickness. Then, a sheet of Japanese paper having a basis weight of 10 g/m$^2$ was laminated to the film on the side opposite to the liquid absorbing layer to obtain a heat-sensitive stencil sheet.

Then, the photothermal conversion material containing liquid, which consists of 3 parts by weight of carbon black, 47 parts by weight of water, 40 parts by weight of diethylene glycol and 10 parts by weight of isopropyl alcohol, was ejected from a liquid-ejecting means connected to a heating element to transfer and fix the liquid onto the heat-sensitive stencil sheet in the form of letter image so that the recorded dots had a diameter of 40 $\mu$m and the pitch between the dots was 60 $\mu$m. In this moment, the contact angle of the liquid with the liquid absorbing layer to which the liquid was transferred was 70 degrees.

Then, light was radiated to letter image portions to which the photothermal conversion material had been fixed, by use of a xenon flash (SP275 manufactured by RISO KAGAKU CORPORATION) in the same manner as in Example 1. As a result, thanks to heat emitted by the letter image portions, the stencil sheet was molten and perforated. It was confirmed that the perforation state of the stencil sheet was such that diameter of the perforations was 50 $\mu$m and the dots were independent from each other.

Then, stencil printing was effected using a digital stencil printing apparatus "RISOGRAPH GR275" (trade name) manufacture by RISO KAGAKU CORPORATION with the perforated stencil sheet being wound around the printing drum of the printing apparatus. As a result, sharp images were obtained.

According to the present invention, dots of a photothermal conversion material are recorded on a heat-sensitive stencil sheet in the form of images such as letters so that diameter R of dot and pitch D between the dots satisfy the relation $3R \geqq D > R$, and, therefore, when the heat-sensitive stencil sheet is perforated by exposing it to a visible or infrared ray, the perforated portions are formed as perforations independent from each other at appropriate intervals and thus a clear print of high quality which is high in density and free from seep through is provided.

What is claimed is:

1. A method of perforating a heat-sensitive stencil sheet, which comprises ejecting a photothermal conversion material contained in a liquid from a liquid-ejecting means to transfer it together with said liquid in the form of dots onto a heat-sensitive stencil sheet, and then exposing said heat-sensitive stencil sheet to a visible or infrared ray to perforate said heat-sensitive stencil sheet specifically at portions to which said photothermal conversion material has been transferred, wherein said dots satisfy the relation $3R \geqq D > R$ in which R is a diameter of the dot of said photothermal conversion material transferred and recorded onto said heat-sensitive stencil sheet and D is a pitch between adjacent dots.

2. A perforating method according to claim 1, further comprising said heat-sensitive stencil sheet with a liquid absorbing layer on at least one side, and ejecting said liquid containing said photothermal conversion material onto said liquid absorbing layer.

3. A perforating method according to claim 2, further comprising said liquid with water, and providing a contact angle of 20 to 150 degrees between said liquid absorbing layer and said liquid that has been transferred to said layer.

4. A perforating method according to claim 3, further comprising said liquid absorbing layer with a hydrophilic resin and a water-repellent compound.

5. A perforating method according to claim 4, further comprising said liquid absorbing layer with organic particulates.

6. A perforating method according to claim 4, further comprising said liquid absorbing layer with inorganic particles.

7. A perforating method according to claim 2, further comprising said liquid absorbing layer with a softening or melting point of 40 to 120° C.

8. A perforating method according to claim 2, further comprising said liquid absorbing layer with a thickness of 0.01 to 20 $\mu$m.

9. A perforating method according to claim 2, further comprising said liquid with water and hydrophilic solvent, and providing a contact angle of 20 to 150 degrees between said liquid absorbing layer and said liquid that has been transferred to said layer.

10. A perforating method according to claim 2, further comprising said liquid with a hydrophilic solvent, and providing a contact angle of 20 to 150 degrees between said liquid absorbing layer and said liquid that has been transferred to said layer.

* * * * *